US006135929A

United States Patent [19]

Warner

[11] Patent Number: 6,135,929

[45] Date of Patent: Oct. 24, 2000

[54] WALKING ASSISTANCE DEVICE

[76] Inventor: Sandra C. Warner, Rte. 2 Box 708, Bridgeport, Va. 26330

[21] Appl. No.: 09/443,977

[22] Filed: Nov. 19, 1999

[51] Int. Cl.[7] ..... A63B 22/00

[52] U.S. Cl. ..... 482/69

[58] Field of Search ..... 482/69, 51, 148, 482/908, 54; 602/36, 23, 34; 297/274, 275; 472/15

[56] References Cited

U.S. PATENT DOCUMENTS

| | | | |
|---|---|---|---|
| 111,813 | 7/1871 | Colvin | 482/69 |
| 2,871,915 | 2/1959 | Hogan | 482/69 |
| 3,204,954 | 9/1965 | Scannell | 482/69 |
| 4,252,063 | 2/1981 | Brooks | 482/69 |
| 5,626,540 | 5/1997 | Hall | 606/241 |

*Primary Examiner*—Stephen R. Crow

[57] ABSTRACT

A walking assistance device for assisting people to walk without fear of falling. The walking assistance device includes a first support apparatus comprising a first elongate pole having a first end and a second end. A pulley wheel is mounted to a first end of the first support pole. A second support apparatus is substantially identical to the first support apparatus. Each of the support apparatuses is oriented such that each of the convex peripheral edges of the pulley wheels facing each other. A first and a second anchor support each of the support apparatuses. Each of the anchors has pin mounted in it. Each of the pins has a top portion extending away from a top surface of the anchors. A first cable has a first end and a second end. The first end of the first cable is removably coupled to the top portion of the pin mounted in the first anchor. The second end of the first cable is removably coupled to the top portion of the pin mounted in the second anchor. The first cable extends between the pulleys on the first and the second support apparatus. A user wears a harness. A second cable binds the harness to the first cable. The cable has a first and second end. A first hook couples the first end of the second cable to the harness. A second hook couples the second end of the second cable to a pulley mounted on the first cable.

9 Claims, 3 Drawing Sheets

WALKING ASSISTANCE DEVICE

BACKGROUND OF THE INVENTION

1. Field of the Invention

The present invention relates to walking devices and more particularly pertains to a new walking assistance device for assisting people to walk without fear of falling.

2. Description of the Prior Art

The use of walking devices is known in the prior art. More specifically, walking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,204,954; U.S. Pat. No. 2,871,915; U.S. Pat. No. 4,989,118; U.S. Pat. Des. No. 384,712; U.S. Pat. No. 5,695,432; and U.S. Pat. No. 5,667,461.

While these devices fulfill their respective, particular objectives and requirements, the aforementioned patents do not disclose a new walking assistance device. The inventive device includes a first support apparatus comprising a first elongate pole having a first end and a second end. The first end of the first pole is mountable in the ground. A pulley wheel having a generally convex peripheral edge forming a groove is mounted to a first end of the first support pole. A second support apparatus is substantially identical to the first support apparatus. Each of the support apparatuses is oriented such that each of the convex peripheral edges of the pulley wheels facing each other. A first and a second anchor for supporting each of the support apparatus are mountable in the ground. Each of the anchors has pin mounted in it. Each of the pins has a top portion and a bottom portion. Each bottom portions of the pins are within the anchor, and each top portions of the pins extend away from a top surface of the anchors. A first cable has a first end and a second end. The first end of the first cable is removably coupled to the top portion of the pin mounted in the first anchor. The second end of the first cable is removably coupled to the top portion of the pin mounted in the second anchor. The first cable extends between the pulleys on the first and the second support apparatus. A user wears a harness. A second cable binds the harness to the first cable. The cable has a first and second end. A first hook releasably couples the first end of the second cable to the harness. A second hook releasably couples the second end of the second cable to a pulley mounted on the first cable.

In these respects, the walking assistance device according to the present invention substantially departs from the conventional concepts and designs of the prior art, and in so doing provides an apparatus primarily developed for the purpose of assisting people to walk without fear of falling.

SUMMARY OF THE INVENTION

In view of the foregoing disadvantages inherent in the known types of walking devices now present in the prior art, the present invention provides a new walking assistance device construction wherein the same can be utilized for assisting people to walk without fear of falling.

The general purpose of the present invention, which will be described subsequently in greater detail, is to provide a new walking assistance device apparatus and method which has many of the advantages of the walking devices mentioned heretofore and many novel features that result in a new walking assistance device which is not anticipated, rendered obvious, suggested, or even implied by any of the prior art walking devices, either alone or in any combination thereof.

To attain this, the present invention generally comprises a first support apparatus comprising a first elongate pole having a first end and a second end. The first end of the first pole is mountable in the ground. A pulley wheel having a generally convex peripheral edge forming a groove is mounted to a first end of the first support pole. A second support apparatus is substantially identical to the first support apparatus. Each of the support apparatuses is oriented such that each of the convex peripheral edges of the pulley wheels facing each other. A first and a second anchor for supporting each of the support apparatus are mountable in the ground. Each of the anchors has pin mounted in it. Each of the pins has a top portion and a bottom portion. Each bottom portions of the pins are within the anchor, and each top portions of the pins extend away from a top surface of the anchors. A first cable has a first end and a second end. The first end of the first cable is removably coupled to the top portion of the pin mounted in the first anchor. The second end of the first cable is removably coupled to the top portion of the pin mounted in the second anchor. The first cable extends between the pulleys on the first and the second support apparatus. A user wears a harness. A second cable binds the harness to the first cable. The cable has a first and second end. A first hook releasably couples the first end of the second cable to the harness. A second hook releasably couples the second end of the second cable to a pulley mounted on the first cable.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new walking assistance device apparatus and method which has many of the advantages of the walking devices mentioned heretofore and many novel features that result in a new walking assistance device which is not anticipated, rendered obvious, suggested, or even implied by any of the prior art walking devices, either alone or in any combination thereof.

It is another object of the present invention to provide a new walking assistance device which may be easily and efficiently manufactured and marketed.

It is a further object of the present invention to provide a new walking assistance device which is of a durable and reliable construction.

An even further object of the present invention is to provide a new walking assistance device which is susceptible of a low cost of manufacture with regard to both materials and labor, and which accordingly is then susceptible of low prices of sale to the consuming public, thereby making such walking assistance device economically available to the buying public.

Still yet another object of the present invention is to provide a new walking assistance device which provides in the apparatuses and methods of the prior art some of the advantages thereof, while simultaneously overcoming some of the disadvantages normally associated therewith.

Still another object of the present invention is to provide a new walking assistance device for assisting people to walk without fear of falling.

Yet another object of the present invention is to provide a new walking assistance device which includes a first support apparatus comprising a first elongate pole having a first end and a second end. The first end of the first pole is mountable in the ground. A pulley wheel having a generally convex peripheral edge forming a groove is mounted to a first end of the first support pole. A second support apparatus is substantially identical to the first support apparatus. Each of the support apparatuses is oriented such that each of the convex peripheral edges of the pulley wheels facing each other. A first and a second anchor for supporting each of the support apparatus are mountable in the ground. Each of the anchors has pin mounted in it. Each of the pins has a top portion and a bottom portion. Each bottom portions of the pins are within the anchor, and each top portions of the pins extend away from a top surface of the anchors. A first cable has a first end and a second end. The first end of the first cable is removably coupled to the top portion of the pin mounted in the first anchor. The second end of the first cable is removably coupled to the top portion of the pin mounted in the second anchor. The first cable extends between the pulleys on the first and the second support apparatus. A user wears a harness. A second cable binds the harness to the first cable. The cable has a first and second end. A first hook releasably couples the first end of the second cable to the harness. A second hook releasably couples the second end of the second cable to a pulley mounted on the first cable.

Still yet another object of the present invention is to provide a new walking assistance device that can be used for rehabilitating people who have an injury which impedes walking.

Even still another object of the present invention is to provide a new walking assistance device that can be used for training toddlers to walk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there arc illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
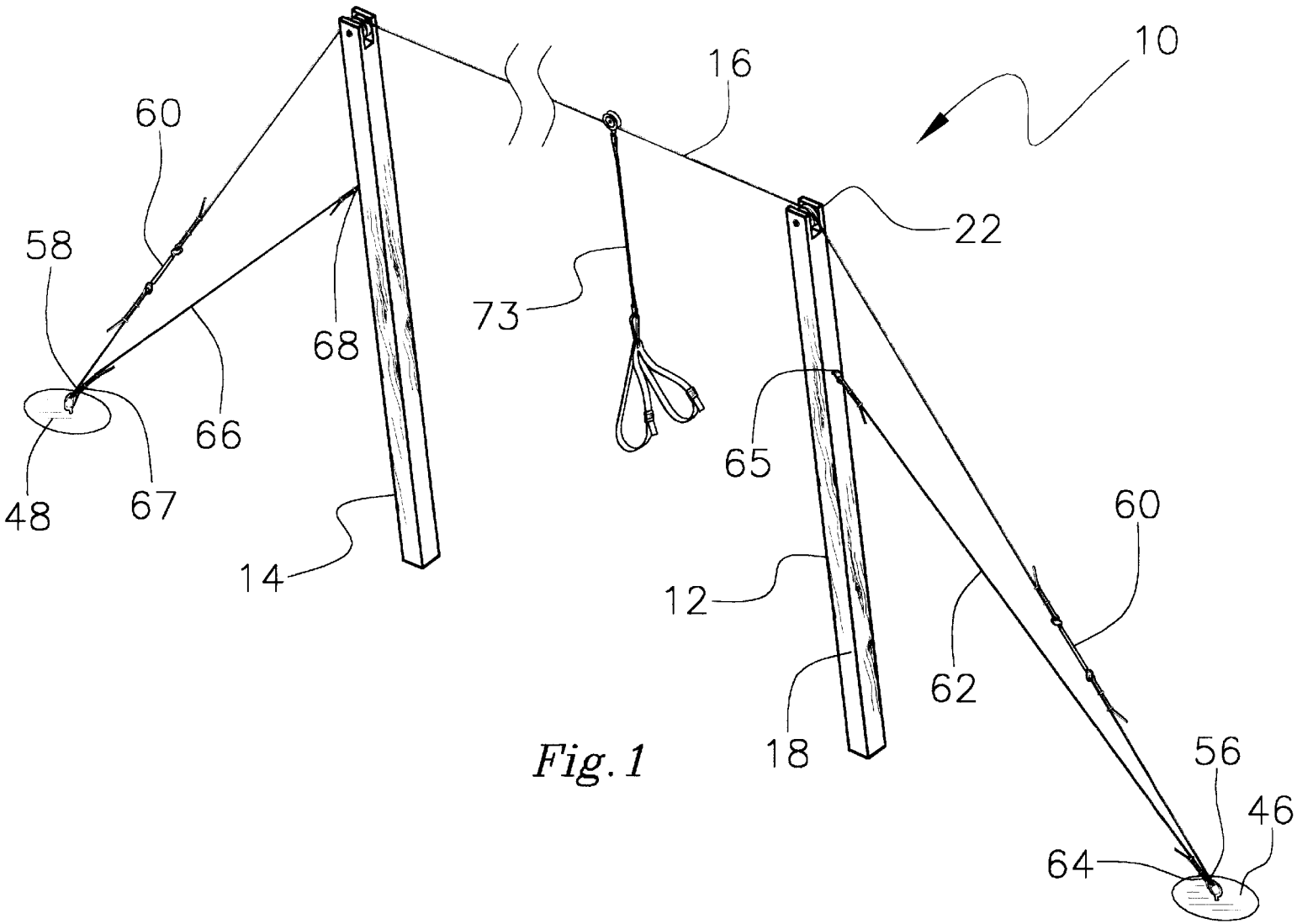
FIG. 1 is a schematic perspective view of a new walking assistance device according to the present invention.
Figure 2:
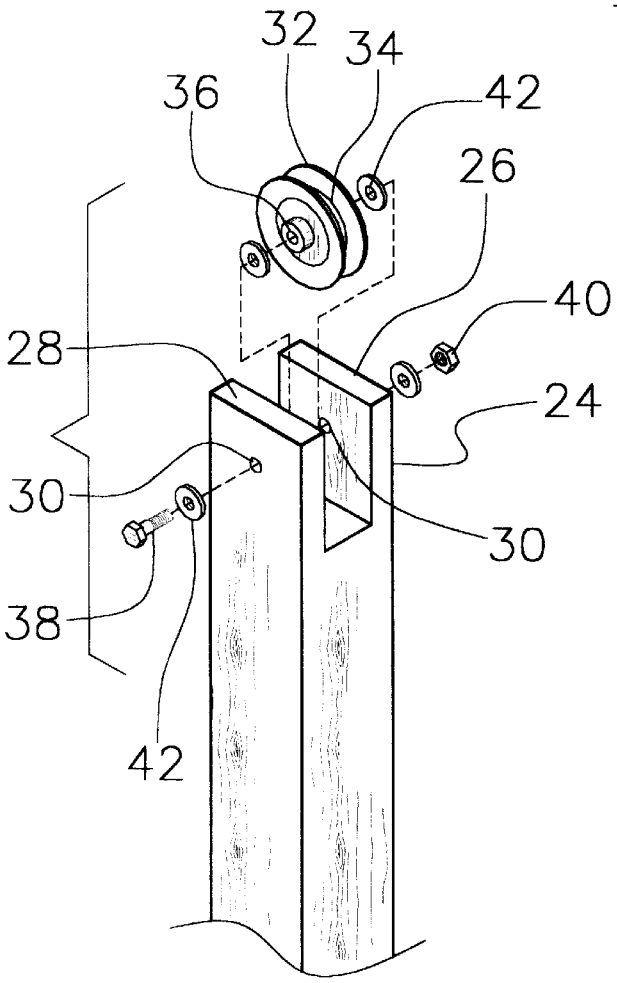
FIG. 2 is a schematic perspective view of the pulley wheel and slot of the present invention.
Figure 3:
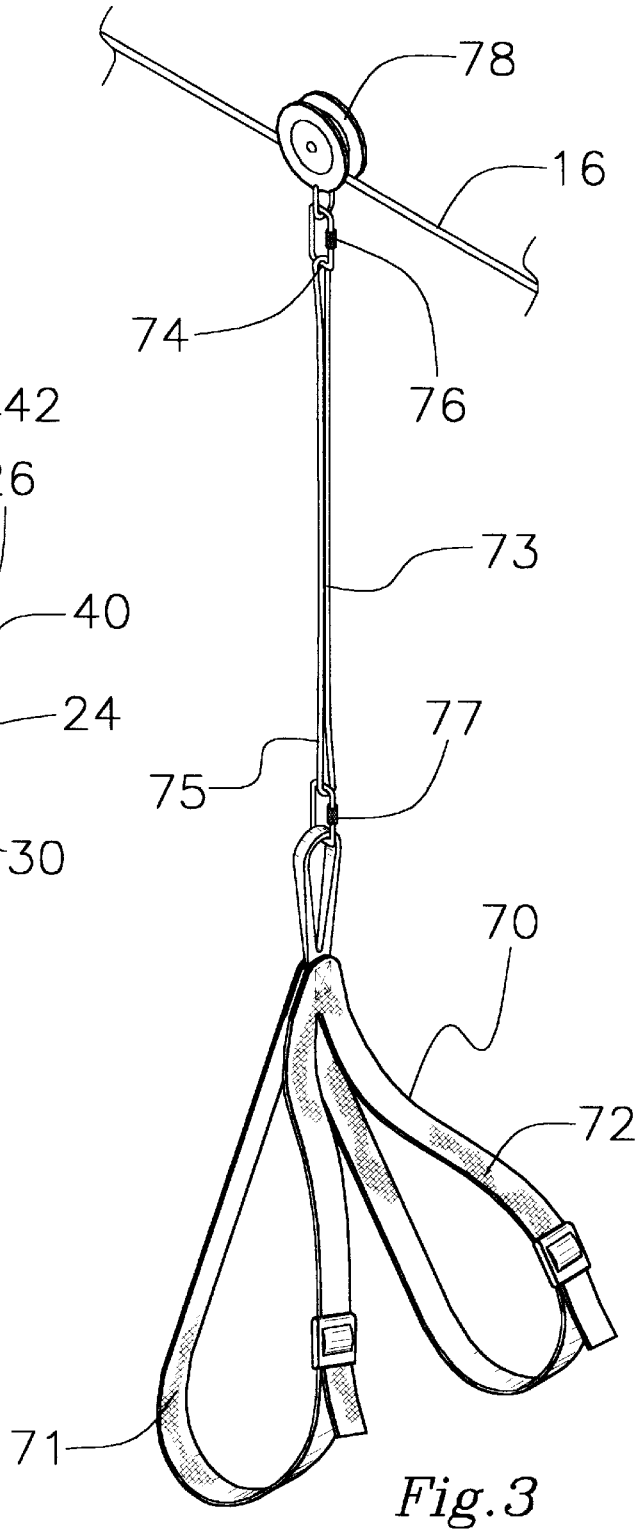
FIG. 3 is a schematic perspective view of the harness of the present invention.
Figure 4:
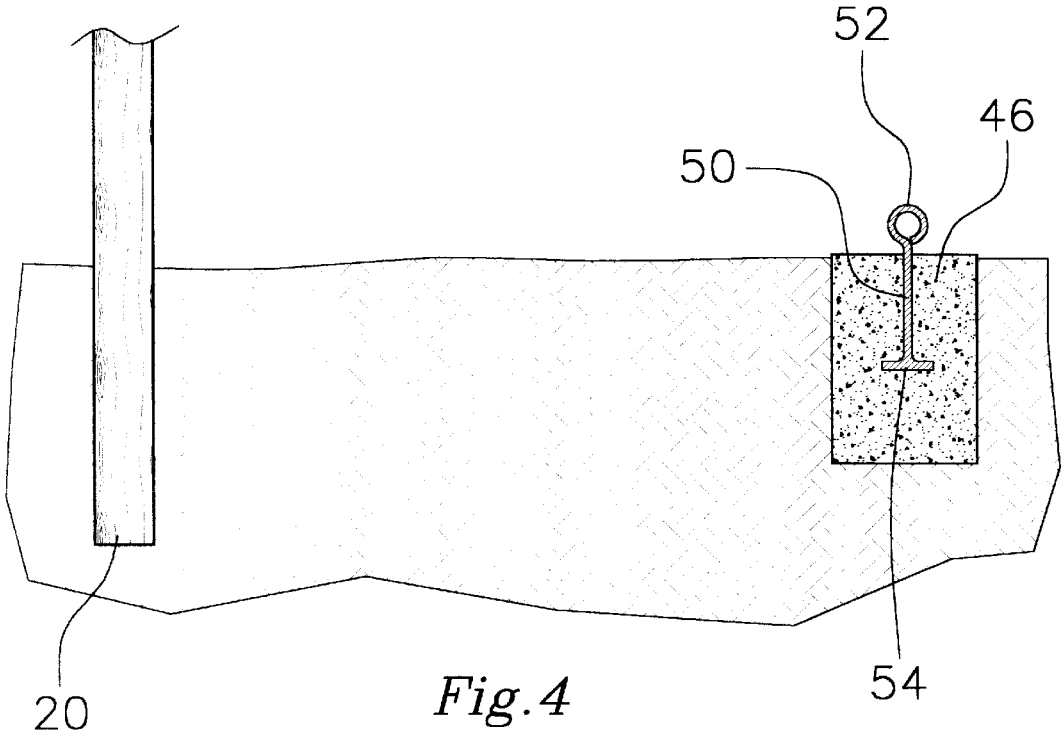
FIG. 4 is a schematic side view of the anchor of the present invention.

With reference now to the drawings, and in particular to FIGS. 1 through 4 thereof, a new walking assistance device embodying the principles and concepts of the present invention and generally designated by the reference numeral 10 will be described.

As best illustrated in FIGS. 1 through 4, the walking assistance device 10 generally comprises a first support apparatus 12 and a second support apparatus 14 connected by a first cable 16. The first support apparatus comprises a first pole 18. The first pole is elongate having a first end 20 and a second end 22. The first end 20 of the first pole is mountable in the ground. The pole 18 has a generally rectangular shape.

Preferably, a slot 24 is in the second end 22 of the first pole 18. The slot 24 has a generally rectangular shape, wherein two upstanding members 26, 28 are formed by the slot. The upstanding members 26, 28 are located on opposite sides of the slot 24 and are oriented generally parallel to each other.

A bore 30 is formed in each of the upstanding members 26. 28. The bores are oriented in generally opposed sides of the slot. The bores are coaxial with respect to each other.

A pulley wheel 32 is mounted in the slot 24. The pulley wheel 32 preferably has a radius length less than a depth of the slot. The pulley wheel 32 has a generally convex peripheral edge 34 forming a groove. The pulley wheel has bore 36 therethrough which is generally located in an axis of the pulley wheel 32.

A bolt 38 secures the pulley wheel 32 in the slot 30. The bolt 38 is inserted through the bores 26, 28 in the upstanding members and through the bore in the pulley wheel. The pulley wheel 32 is rotatably secured by the bolt 38. A nut 40 secures the bolt.

A plurality of washers 42 are located on the bolt. The washers 42 are located between an inner surface of each of the upstanding members 26, 28 and the pulley wheel 32. One of the washers 42 is positioned between an outside surface of the upstanding member 26 and the nut 40. One of the washers 42 is between the outside surface of the upstanding member 28 and a head of the bolt 38.

A second support apparatus 14 is substantially identical to the first support apparatus 12. Preferably, the second support apparatus 14 is oriented substantially parallel to the first support apparatus 12. Each of the support apparatuses are oriented such that each of the convex peripheral edges 34 of the pulley wheels 32 are facing each other.

A first 46 and a second anchor 48 support each of the support apparatus. Each of the anchors is mountable in the ground. The anchors are generally positioned on a line joining the first 12 and second 14 support apparatuses. The first and second support apparatuses are between the first 46 and second anchors 48. Preferably, the anchors are comprised of cement blocks.

A pair of pins 50 are fixedly mounted in each of the anchors. Each of the pins has a top portion 52 and a bottom portion 54. Each bottom portion 54 of the pins is within the anchor and each top portion 52 of the pins extends away from a top surface of the anchors. Preferably, each of the top portions 52 of the pins generally forms a ring.

A first cable 16 has a first 56 end and a second end 58. Preferably, the cable 16 is adapted to have a variable effective length. The first end 56 of the first cable is removably coupled to the ring on the pin 50 mounted in the first anchor 46. The second end 58 of the first cable is removably coupled to the ring on the pin mounted in the second anchor 48. The first cable 16 is received on and extends between the pulleys 32 on the first 12 and the second support apparatus 14.

Preferably, a turnbuckle 60 is used for adjusting the effective length of the first cable 14 between the rings of the first and second anchors.

A second cable 62 anchors the first support apparatus 12 and has a first 64 and second end 65. The first end 64 of the second cable 62 is removably coupled to the ring on the pin mounted in the first anchor 46. The second end 65 of the second cable is removably coupled to the first support apparatus 12.

A third cable 66 anchors the second support apparatus 14 and has a first 67 and second end 68. The first end 67 of the third cable is removably coupled to the ring on the pin mounted in the second anchor 48, and the second end 68 of the third cable is removably coupled to the second support apparatus 14.

A user wears a harness 70. The harness has two straps 71, 72. Each of the straps 71, 72 generally forms a loop, each of which is adapted to has a variable length. The straps 71, 72 are fixedly coupled together.

A fourth cable 73 binds the harness 70 to the first cable 16. The fourth cable 73 has a first 74 and second end 75.

A first hook 76 releasably couples the first end 74 of the fourth cable 73 to the harness 70. A second hook 77 releasably couples the second end 75 of the fourth cable 73 to a pulley 78 mounted on the first cable 16. The pulley 78 on the first cable 16 is located between the first 12 and second 14 support apparatuses.

In use, the first 12 and second 14 support apparatuses are mounted in the ground surface. If in soil, they are driven into the soil. The supports can also be mounted inside within cavities, not shown, created for that purpose. Anchors 46, 48 are placed outside of the supports and are preferably fixedly mounted into the ground. The first cable 14 is strung from one anchor to the next and extending between the wheel pulleys. The first cable is then tightened with the turnbuckle 60. The second 62 and third 66 cables are then attached to the support apparatuses 12,14 and are secured to the anchors 46, 48. A fourth cable 73 is attached to a pulley 78 which is located on the first cable 14 between the first and second apparatuses. A harness 70 is attached to the other end of the fourth cable 73. The harness 70 is adjusted to fit the user. The user then places the harness on and walks back and forth between the supports without fear of falling.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A walking assistance device, said device comprising:

a first support apparatus comprising:

a first pole, said first pole being elongate, said first pole having a first end and a second end, said first end of said first pole being mountable in the ground;

a pulley wheel, said pulley wheel having a generally convex peripheral edge forming a groove, said pulley being mounted to the second end of said first pole;

a second support apparatus comprising:

second pole, said second pole being elongate, said second pole having a first end and a second end, said first end of said second pole being mountable in the ground;

a pulley wheel, said pulley wheel having a generally convex peripheral edge forming a groove said pulley being mounted to the second end of said second pole;

each of said support apparatuses being oriented such that each of said convex peripheral edges of said pulley wheels facing each other;

a first and a second anchor for supporting each of said support apparatus, each of said anchors being mountable in the ground, said first and second support apparatuses being between said first and second anchors;

a pair of pins, one of said pins being fixedly mounted in each of said anchors, each of said pins having a top portion and a bottom portion, each bottom portion of said pins being within said anchor, each top portion of said pins extending away from a top surface of said anchors;

a first cable, said first cable having a first end and a second end, said first end of said first cable being removably coupled to said top portion of said pin mounted in said first anchor, said second end of said first cable being removably coupled to said top portion of said pin mounted in said second anchor, said first cable being received on and extending between said pulleys on said first and said second support apparatus;

a harness for wearing by a user;

a second cable for binding said harness to said first cable, said second cable having a first and second end; and a first and second hook, said first hook releasably coupling said first end of said second cable to said harness, said second hook releasably coupling said second end of said second cable to a pulley mounted on said first cable.

2. The walking assistance device as in claim 1, further comprising comprising:

a slot, said slot being in said second end of said first pole, said slot having a generally rectangular shape, wherein two upstanding members are formed by said slot, said upstanding members being located on opposite sides of said slot, said upstanding members being oriented generally parallel to each other;

a pair of bores, one of said bores being formed in each of said upstanding members, said bores being oriented in generally opposed sides of said slot, said bores being coaxial;

wherein said pulley wheel has a radius length less than a depth of said slot, said pulley wheel having bore therethrough, said bore being generally located in an axis of said pulley wheel;

a bolt for securing said pulley wheel in said slot, said bolt being inserted through said bores in said upstanding members and through said bore in said pulley wheel, said pulley wheel being rotatably secured by said bolt;

a nut for securing said bot; and wherein said second support apparatus has a substantially slot and pulley wheel assembly.

3. The walking assistance device as in claim 2, further comprising:

a plurality of washers, said washers being located on said bolts, said washers being located between an inner surface of each of said upstanding members and said pulley wheels, one of said washers being positioned between an outside surface of said upstanding members and each of said nuts, one of said washers being between said an outside surface of said upstanding member and a head of each of said bolts.

4. The walking assistance device as in claim 3, wherein said second support apparatus is oriented substantially parallel to said first support apparatus.

5. The walking assistance device as in claim 1, wherein said first cable is adapted to having a variable effective length.

6. The walking assistance device as in claim 5, further including:

a turnbuckle for adjusting the effective length of said first cable between the pins of the first and second anchors.

7. The walking assistance device as in claim 1, further comprising:

a third cable for anchoring said first support apparatus, said third cable having a first and second end, said first end of said third cable being removably coupled to said top portion of said pin mounted in said first anchor, said second end of said third cable being removably coupled to said first support apparatus; and a fourth cable for anchoring said second support apparatus, said fourth cable having a first and second end, said first end of said fourth cable being removably coupled to said top portion of said pin mounted in said second anchor, said second end of said fourth cable being removably coupled to said second support apparatus.

8. The walking assistance device as in claim 7, wherein said harness comprises:

said harness having two straps, each of said straps generally forming a loop, each of said loops being adapted to having a variable length, said straps being fixedly coupled together.

9. A walking assistance device, said device comprising:

a first support apparatus comprising:

a first pole, said first pole being elongate, said first pole having a first end and a second end, said first end of said first pole being mountable in thc ground, said pole having a generally rectangular shape;

a slot, said slot being in said second end of said first pole, said slot having a generally rectangular shape, wherein two upstanding members are formed by said slot, said upstanding members being located on opposite sides of said slot, said upstanding members being oriented generally parallel to each other;

a pair of bores, one of said bores being formed in each of said upstanding members, said bores being oriented in generally opposed sides of said slot, said bores being coaxial;

a pulley wheel, said pulley wheel having a radius length less than a depth of said slot, said pulley wheel having a generally convex peripheral edge forming a groove, said pulley wheel having bore therethrough, said bore being generally located in an axis of said pulley wheel;

a bolt for securing said pulley wheel in said slot, said bolt being inserted through said bores in said upstanding members and through said bore in said pulley wheel, said pulley wheel being rotatably secured by said bolt;

a nut for securing said bolt;

a plurality of washers, said washers being located on said bolt, said washers being located between an inner surface of each of said upstanding members and said pulley wheel, one of said washers being positioned between an outside surface of said upstanding member and said nut, one of said washers being between said an outside surface of said upstanding member and a head of said bolt;

a second support apparatus comprising;

a second pole, said second pole being elongate, said second pole having a first end and a second end, said first end of said second pole being mountable in the ground, said pole having a generally rectangular shape;

a slot, said slot being in said second end of said first pole, said slot having a Generally rectangular shape, wherein two upstanding members are formed by said slot, said upstanding members being located on opposite sides of said slot, said upstanding members being oriented generally parallel to each other;

a pair of bores, one of said bores being formed in each of said upstanding members said bores being oriented in generally opposed sides of said slot, said bores being coaxial;

a pulley wheel, said pulley wheel having a radius length less than a depth of said slot said pulley wheel having a generally convex peripheral edge forming a groove, said pulley wheel having bore therethrough, said bore being generally located in an axis of said pulley wheel;

a bolt for securing said pulley wheel in said slot, said bolt being inserted through said bores in said upstanding members and through said bore in said pulley wheel, said pulley wheel being rotatable secured by said bolt;

a nut for securing said bolt;

a plurality of washers, said washers being located on said bolt, said washers being located between an inner surface of each of said upstanding members and said pulley wheel, one of said washers being positioned between an outside surface of said upstanding member and said nut, one of said washers being between said an outside surface of said upstanding member and a head of said bolt;

said second support apparatus being oriented substantially parallel to said first support apparatus, each of said support apparatuses being oriented such that each of said convex peripheral edges of said pulley wheels face each other;

a first and a second anchor for supporting each of said support apparatus, each of said anchors being mountable in the ground, said anchors being generally positioned on a line joining said first and second support apparatuses, said first and second support apparatuses being between said first and second anchors, said anchors comprising cement blocks;

a pair of pins, one of said pins being fixedly mounted in each of said anchors, each of said pins having a top portion and a bottom portion, each bottom portion of said pins being within said anchor, each top portion of said pins extending away from a top surface of said anchors, each of said top portions of said pins generally forming a ring;

a first cable, said first cable having a first end and a second end, said cable being adapted to having a variable effective length, said first end of said first cable being removably coupled to said ring on said pin mounted in said first anchor, said second end of said first cable being removably coupled to said ring on said pin mounted in said second anchor, said first cable being received on and extending between said pulleys on said first and said second support apparatus;

a turnbuckle for adjusting the effective length of said first cable between the rings of the first and second anchors;

a second cable for anchoring said first support apparatus, said second cable having a first and second end said first end of said second cable being removably coupled to said ring on said pin mounted in said first anchor, said second end of said second cable being removably coupled to said first support apparatus;

a third cable for anchoring said second support apparatus, said third cable having a first and second end, said first end of said third cable being removably coupled to said ring on said pin mounted in said second anchor, said second end of said third cable being removably coupled to said second support apparatus;

a harness for wearing by a user, said harness having two straps, each of said straps generally forming a loop, each of said loops being adapted to having a variable length, said straps being fixedly coupled together;

a fourth cable for binding said harness to said first cable, said fourth cable having a first and second end; and a first and second hook, said first hook releasably coupling said first end of said fourth cable to said harness, said second hook releasably coupling said second end of said fourth cable to a pulley mounted on said first cable, wherein said pulley on said first cable is located between said first and second support apparatuses.

* * * * *